United States Patent [19]

Holtz

[11] 4,255,837

[45] Mar. 17, 1981

[54] MAGNETIC CLIP DEVICE

[75] Inventor: Herman Holtz, Wiesbaden-Nordenstadt, Fed. Rep. of Germany

[73] Assignee: Magnetoplan H. Jo. Holtz, Wiesbaden-Nordenstadt, Fed. Rep. of Germany

[21] Appl. No.: 47,381

[22] Filed: Jun. 11, 1979

[30] Foreign Application Priority Data

Jul. 27, 1978 [DE] Fed. Rep. of Germany ..... 2832998

[51] Int. Cl.[3] ..... A44B 21/00; A45C 1/06; G09F 3/00

[52] U.S. Cl. ..... 24/243 R; 24/81 MC; 24/67 R; 24/201 B; 40/1.5; 40/11 R; 40/20 R

[58] Field of Search ..... 116/204; 33/DIG. 1; 248/206 R; 40/600, 23 A, 620, 1.5, 11 R, 20 R, 621; 35/7 A; 150/38; 24/81 MC, 73 MS, 243 R

[56] References Cited

U.S. PATENT DOCUMENTS

| | | | |
|---|---|---|---|
| 2,448,611 | 9/1948 | Martin | 116/234 |
| 2,557,398 | 6/1951 | Teetor | 35/7 A |
| 2,784,757 | 3/1957 | Bosca et al. | 150/38 X |
| 2,959,832 | 11/1960 | Baermann | 24/73 MS |
| 3,238,643 | 3/1966 | O'Connor | 35/7 A X |
| 3,468,576 | 9/1969 | Beyer et al. | 24/201 B |
| 3,529,328 | 5/1969 | Davison | 24/73 MS |
| 3,552,047 | 1/1971 | Dalziel | 40/23 A |
| 3,654,711 | 4/1972 | Taylor | 35/7 A X |
| 3,698,111 | 10/1972 | Smith | 40/600 X |

FOREIGN PATENT DOCUMENTS

| | | | |
|---|---|---|---|
| 776372 | 1/1968 | Canada | 35/7 A |

OTHER PUBLICATIONS

Publ. "What You Can Do With Flexible Magnets", by AR Gardner, Product Engineering, Jan. 9, 1961, pp. 65–68.

*Primary Examiner*—Daniel M. Yasich
*Attorney, Agent, or Firm*—Allison C. Collard; Thomas M. Galgano

[57] ABSTRACT

A magnetic clipping device especially suitable for magnetically retaining on ferromagnetic walls sheet-like articles which may also be stitched or bound together, consists of two permanent magnet face-like elements between which the article is retained which are coupled with each other by a joint or hinge. The permanent magnet elements each consist of a relatively thin permanent magnet foil having a thickness up to 1mm which consists of a rubber- or plastic resin-based anisotropic powder like permanent magnet material. The foils are thoroughly magnetized to define relatively wide stripe-like magnet poles for generating magnetic adhering faces, and the permanent magnet foils are so disposed that opposite stripe-like pole faces face opposite one another.

18 Claims, 19 Drawing Figures

MAGNETIC CLIP DEVICE

The present invention relates to a magnetic clip or clipping device. More particularly, it relates to a magnetic clipping device especially suitable for magnetically retaining on ferromagnetic walls sheet-like articles. The sheet-like articles may also be stitched or bound together, for example, printed pieces, reminder or memo slips, card-index cards, bank notes, stitched or bound periodicals, folded brochures, etc.

A magnetic-actuated clip is known which consists of two face-like square or round permanent magnets which are coupled with each other by means of a hinge or a joint, e.g., made of a plastic material. For clamping sheet-like articles, the articles are inserted between these two magnet elements and are retained therebetween, due to the magnetic attraction or adherence effect which the two magnet elements have on one another.

However, these known magnetic clips are only suitable for clamping relatively thin sheet-like materials. Furthermore, due to the required thickness of the permanent magnet elements, the clips are rather voluminous and bulky and hard to handle. Moreover, these clipped articles cannot be mounted on a ferromagnetic wall, e.g., a ferromagnetic wallpaper.

It is therefore an object of the subject invention to provide a device of the aforementioned type, which does not have the disadvantageous characteristics of the known magnetic clips, and with which it is possible to adhere or retain page-like articles of the above-mentioned type, even in stitched or folded form, onto ferromagnetic wallpaper. Such a retention capability was not possible with the heretofore known clips.

This object of the invention is attained in accordance with the present invention by the provision of a magnetic clipping device especially useful for magnetically retaining a given sheet-like article on ferromagnetic walls which consists of two permanent magnet sheet- or face-like elements, between which the article is retained, which are coupled with each other by a joint or hinge. The device is characterized in that the permanent magnet elements consist of a relatively thin (i.e., up to 1 mm thick) permanent magnetic foil which consists of a rubber- or plastic resin-based anisotropic powder-like permanent magnet material which is thoroughly magnetized so as to provide relatively wide stripe-like magnetic poles for generating magnetic adhering faces. The permanent magnet foils are so disposed such that opposite stripe-like pole faces face opposite each other. For improving the clip and, if need be, the adherence effect, a ferromagnetic sheet metal foil, or a foil of such type may be laminated on the outer or upper permanent magnet foil so as to act as a ground terminal.

With the device in accordance with the present invention, a number of advantages will be obtained. Due to the extremely thin magnetic foil, the clip may be very flat and very light. Furthermore, the anisotropic permanent magnet material which has a relatively wide stripe magnetization with respect to its thickness of about to 1 mm, has a very high retention or adherence power which is considerably enhanced by the soft iron ground terminal which is mounted on the outer or upper permanent magnet foil. This retention or adherence power flows through the total material even in folded or stitched page-like articles like booklets, periodicals, brochures, etc., and it does not only provide an extremely good clamping power with the lower disposed foil, but the lower foil, in turn, has an extremely unexpected good adherence power with respect to the ferromagnetic adhering support face. This is particularly advantageous with respect to ferromagnetic wallpaper which usually consists of paper having a ferromagnetic powder-like material embedded therein. Therefore, this is not a crystalline structure like in a ferromagnetic sheet metal, but an amorphous structure which provides a relatively weak adherence force for commonly-known magnets.

With the device in accordance with the invention it is possible, for the first time, to adhere relatively wide page-like articles like maps, site plans, etc., which have a certain inherent weight onto ferromagnetic wallpaper. This was not possible with the hitherto known circular-shaped permanent magnets.

A large adhering force may be obtained when the two permanent magnet foils are shpaed as relatively elongated rectangular elements, since this creates a large adhering face which generates a good adhering force on ferromagnetic wallpaper. For this purpose, the inner or lower foil, that is, the foil which immediately engages the ferromagnetic tape is wider, so that the thoroughly magnetized lower adhering face is completely effective.

The device in accordance with the invention may be used for any number of purposes for magnetically retaining sheet-like, stitched, folded or bound articles. It is possible to shape the device as card-index, or file cabinet index cards, not only to mark the card and to mount the card-index card onto the index card in a simple manner, but also to mount the card-index card together with other card index cards onto ferromagnetic walls, for example. Furthermore, the device in accordance with the invention may be shaped as a bank note clip which has on its front face advertising prints, for example.

The device may also be shaped as an electronic data processing card retainer for clamping the cards onto ferromagnetic bars or faces. It is also possible to construct the device in accordance with the invention in such a way that, for example, the lower foil is coupled with a clear plastic pouch or bag, in order to mount articles for demonstration purposes, if need be, exchangeably on magnetic adhering faces. Finally, the device may also be used as a marker for pages or files, whereby light files may be adhered to ferromagnetic adhering faces.

Other objects and features of the present invention will become apparent from the following detailed description, considered in connection with the accompanying drawings, which disclose several embodiments of the invention. It is to be understood, however, that the drawing is designed for the purpose of illustration only, and not as a definition of the limits of the invention.

In the drawings, wherein similar reference characters denote similar elements throughout the several views.

Figure 1:
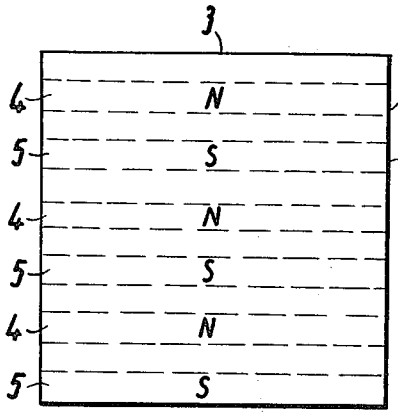
FIG. 1 is a front elevational view of one embodiment of the device in accordance with the present invention.
Figure 2:
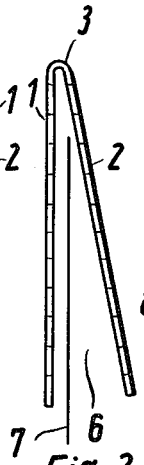
FIG. 2 is a side elevational view of the device shown in FIG. 1, with a sheet-like article positioned between the flaps thereof.
Figure 3:
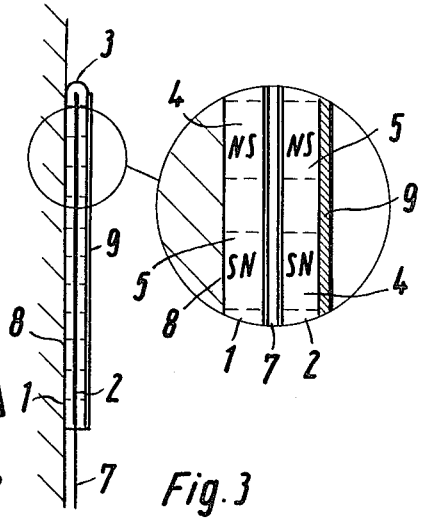
FIG. 3 is a side elevational view of the same device mounted on a ferromagnetic wall, shown clipping a sheet-like article.

Referring now in detail to the drawings, as can be seen from FIGS. 1–3, the device in accordance with the invention consists of two relatively thin (about 1 mm thick) permanent magnet foils 1 and 2 which are coupled with each other by means of a hinge 3 made of plastic material. The two foils consist of a rubber- or plastic resin base, in which is embedded anisotropic, magnetizable powder-like permanent magnet material. Foils 1, 2 are provided with relatively wide stripe-like magnetic poles of alternating polarity 4, 5 for generating magnetic-adhering faces. The magnetization is carried out such that the foils are "through-magnetized", that is, both sides are provided with adhering faces. Thereby, the arrangement is such that, as shown in FIGS. 2 and 3, when mounting the upper of front foil 2 onto the lower or rear foil 1, zones of opposite polarity are always facing each other, so that a relative powerful attraction force is possible between the two foils.

As shown in FIG. 3, a sheet-like article 7 is inserted between the foils 1, 2 for example, a sheet of typewriter paper, a card, a site plan or blueprint, or the like and is maintained therebetween by means of the magnetic clipping action. Due to the "through" magnetization and the corresponding magnetic pole disposition, the total device with the clipped page-like article 7 may be mounted on a ferromagnetic wall 8. The particular advantage of the pole disposition is that the device also adheres on so-called "magnetic wallpaper", which consists of powder-like ferromagnetic material which is embedded into the paper. In such types of paper it was very difficult to adhere articles safely with cylinder-like magnets, since the adhering or retaining force is relatively low.

In order to further increase the adhering power, a soft iron or magnetic ground terminal foil 9 may be mounted on the outer side of ferromagnetic foil 2 which increases the adhering and clipping power.

Naturally, a plurality of sheet-like articles may be superimposed which are then retained safely with the device in accordance with the invention, since the air space between the two permanent magnet foils 1 and 2 may be large, because of the mentioned magnetic pole disposition, without impairing the adherence effect and thereby the clamping effect. In particular, the adhering forces may be a multiple above the required safe retaining force when a relatively rigid (solid) ground terminal foil 9 is used, for example, a soft iron sheet metal foil or plate.

Figure 4:
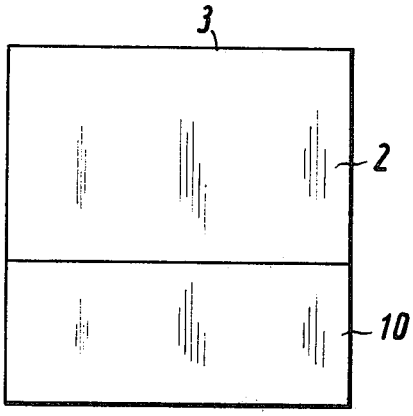
FIG. 4 is a front elevational view of another embodiment of the device in accordance with the present invention.
Figure 5:
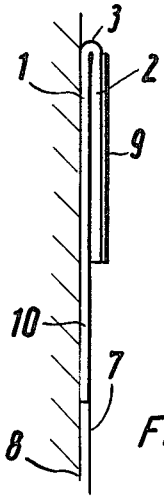
FIG. 5 is a side elevational view of the device shown in FIG. 4 mounted on a ferromagnetic wall, shown clipping a sheet-like article.
Figure 10:
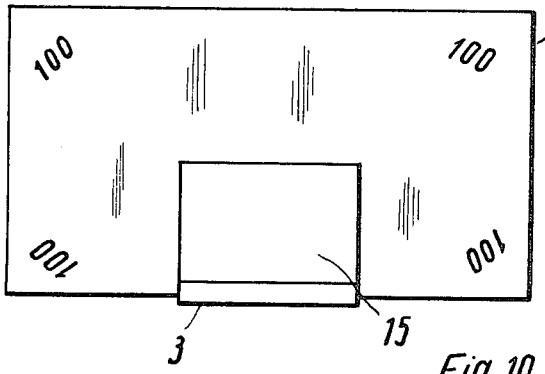
FIG. 10 is a front elevational view of a further embodiment of the invention, in the form of a bank note clip.

FIGS. 4 and 5 illustrate a further embodiment of the invention. In this case, foil 1 has an extended lower end, as shown in FIG. 10, thus increasing the adherence effect on the ferromagnetic wall.

Figure 6:
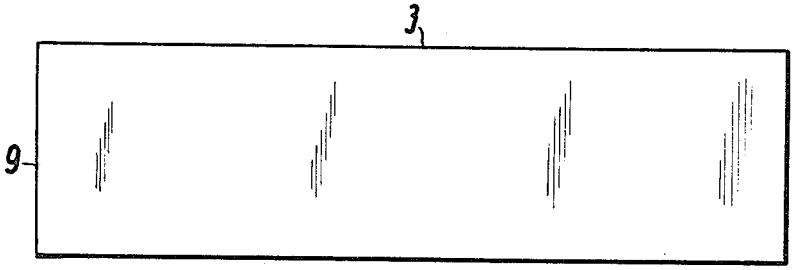
FIG. 6 is a front elevational view of a further embodiment of the device in accordance with the invention.
Figure 7:
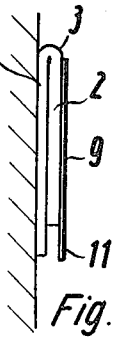
FIG. 7 is a side elevational view of the device shown in FIG. 6, mounted on a ferromagnetic wall.
Figure 8:
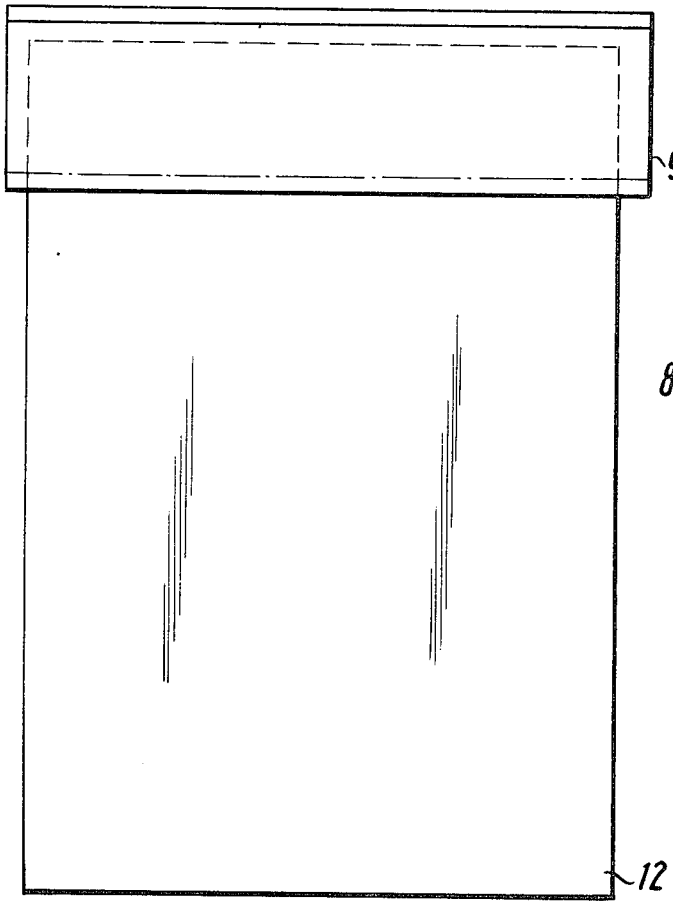
FIG. 8 is a front elevational view of the embodiment shown in FIGS. 6 and 7, further showing a periodical being held thereby.
Figure 9:
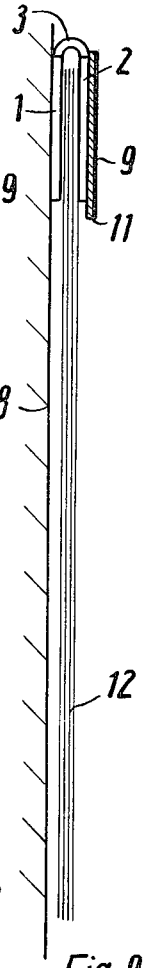
FIG. 9 is a side elevational view of FIG. 8, mounted on a ferromagnetic wall.
Figure 11:
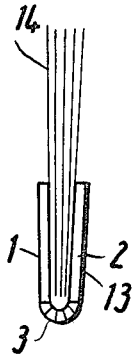
FIG. 11 is a side elevational view of FIG. 10.

FIGS. 6 and 7 illustrate a further embodiment wherein two relatively wide stripe-like permanent magnet foils 1 and 2 are provided with a ground terminal foil 9 which is provided with an overhanging edge 11 for easier handling. This wide embodiment serves for mounting relatively large sheet-like articles, e.g., stitched or bound periodicals, brochures, or the like, which may also be mounted onto ferromagnetic walls in the aforementioned manner. The adhering force is sufficiently large so that even big periodicals may be clipped and retained on the wall. This embodiment is shown in FIGS. 8 and 9, wherein a periodical 12 is clipped and mounted on a ferromagnetic wall 8. FIGS. 10 and 11 illustrate a different embodiment of the device in accordance with the invention. This embodiment relates to a magnetic clip 13 for retaining bank notes 14. The unique advantage is that due to the extreme flatness of the magnetic clip 13, bank notes 14 are encompassed and can be easily stored in a wallet, an envelope or the like. Fields or surfaces 15 for print advertisements may be provided on one or both outer sides of the clip.

Figure 12:
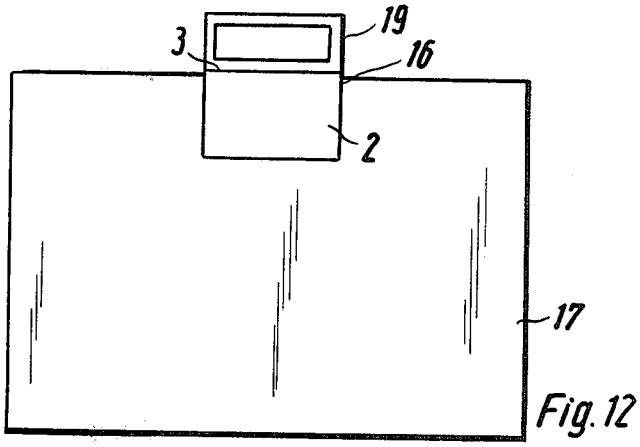
FIG. 12 is a front elevational view of a further embodiment of the invention in the form of file cabinet or card-index card.
Figure 13:
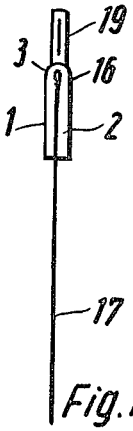
FIG. 13 is a side elevational view of FIG. 12.

FIGS. 12 and 13 show a device in the form of a card or file index card 16, in accordance with the invention. As previously mentioned, the file index card 17 is magnetically clamped. Consequently, index card clip 16 may be used for identifying the information contained on the index card, and may also be mounted together with the card onto magnetic bars or walls for transitory demonstration or for reading. At the upper side of the device, in the area of the plastic hinge 3, a small frame or a window 19 may be mounted in which information or indentifying data may be written down which corresponds to the index card. Naturally, the same arrangement may be used for identifying files by attaching the device onto the file jackets.

Figure 14:
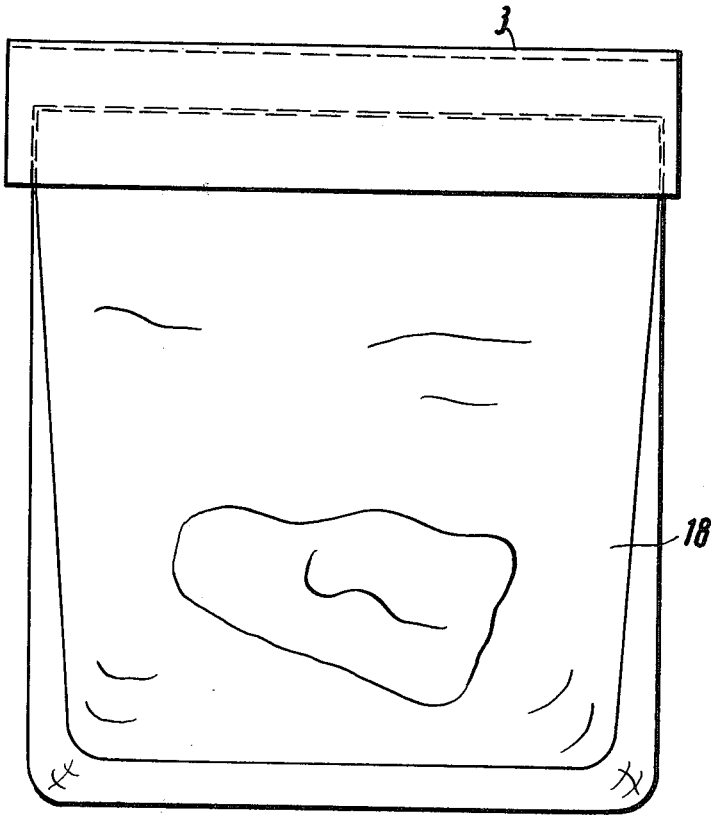
FIG. 14 is a front elevational view of another device in accordance with the invention for mounting a clear plastic pouch or bag.
Figure 15:
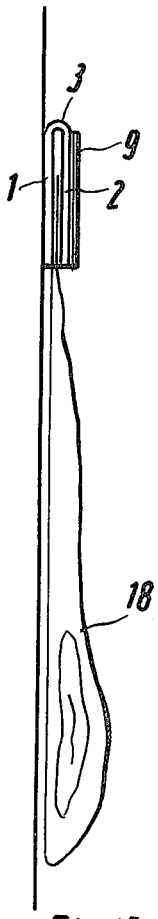
FIG. 15 is a side elevational view of the device and pouch shown in FIG. 14 mounted on a ferromagnetic wall.

FIGS. 14 and 15 illustrate a further embodiment of the device in accordance with the invention. One edge of a clear plastic pouch or bag 18 is mounted on the rear permanent foil 1. The front or second edge of the clear plastic pouch is then pressed onto the first or rear edge, thus closing the pouch. The pouch may then be mounted on ferromagnetic walls in accordance with the invention so as to exhibit the pouch. Naturally, it is also possible to exhibit the contents of closed clear plastic pouches which are mounted on ferromagnetic bars or walls, in accordance with the invention.

Figure 16:
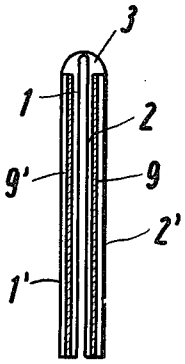
FIG. 16 is a side sectional view of a further embodiment of the device in accordance with the invention.

FIG. 16 illustrates a further embodiment of the device in accordance with the invention which is used, in particular, when strong magnetic forces are required; i.e., strong adhering forces for the sheet-like articles to be received as well as for the adhering force on ferromagnetic walls. In the shown embodiment, a soft iron or magnetic ground terminal sheet or foil 9 is mounted on foil 2 and a further permanent magnet foil 2' is mounted on foil 9, in turn. At the same time a soft iron or magnetic ground terminal foil 9' is mounted between rear foil 1 and an additional rear foil 1' so as to define a sandwich-like structure. Hinge 3 may be simply formed by an adhesive or a resin as a coupling between the two sandwich packs 2,9,2' and 1,9',1; hinge 3 having a reduced cross-section in the center thereof. Naturally, the embodiment shown in FIG. 16 may be combined in any suitable manner with the embodiments shown in FIGS. 1 to 15.

It is important to note that the device in accordance with the invention may be used with particular advantage in drugstores for identifying prescriptions. Furthermore, the device in accordance with the invention may be used as a book marker, in particular for line identification, since the thin foils may be clamped between the pages of a book without causing the pages to bulge. Finally, all devices in accordance with the invention may be provided with a printable and, if need be, erasable surface in order to apply given indicia concerning the clipped articles and, if need be, to remove the indicia therefrom.

The hinge coupling between the two foils may be preferably made with a silicon rubber, which has the advantage that this material may be applied at the front to the foils without creating an air space and still provide an intimate coupling between the two foils. Due to the stampability of the material, one or both of the magnet foils may have an elliptical, circular, semi-circular, multi-cornered or any other desired shape.

Figure 17:
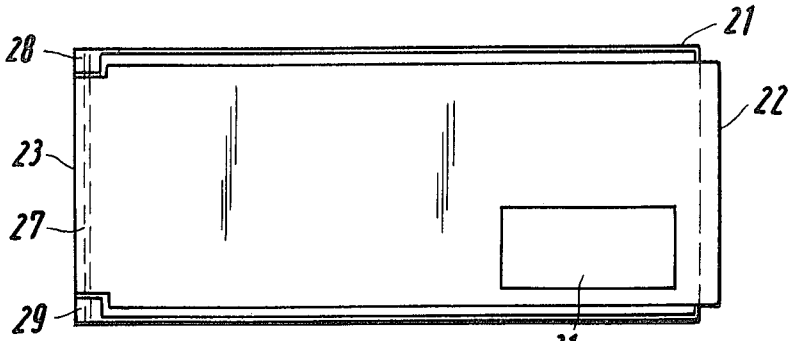
FIG. 17 is a front view of a folded bank note clip in accordance with the invention.
Figure 18:
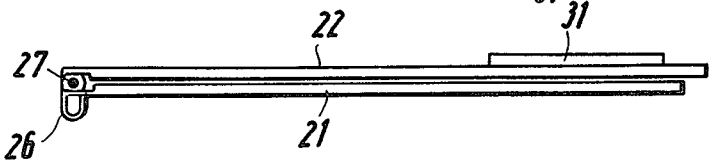
FIG. 18 is a side view of the clip shown in FIG. 17.
Figure 19:
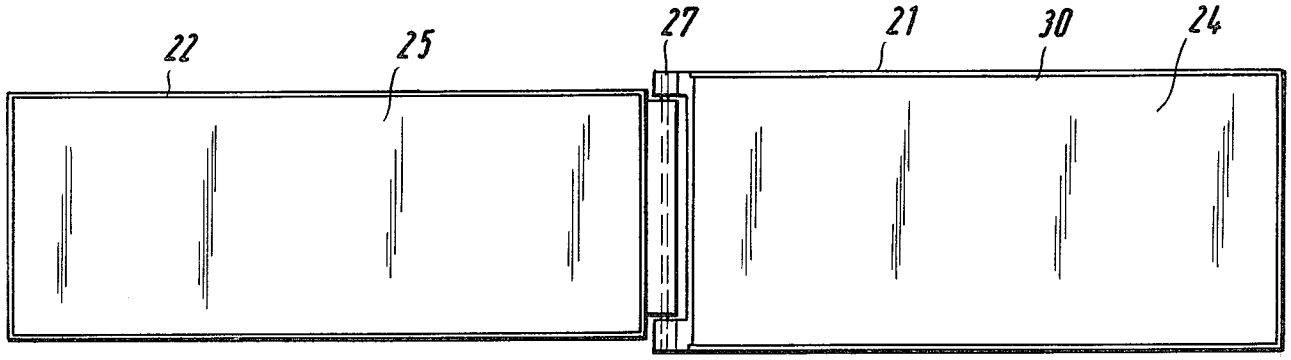
FIG. 19 is a front view of the bank note clip shown in FIGS. 17 and 18, in an unfolded state.

As can be seen from FIGS. 17–19, the bank note clip in accordance with the invention consists of two metal plates 21 and 22 which are coupled with each other by a hinge 23. Two permanent magnet foils 24 and 25 are mounted onto the plates with relatively wide stripe-like magnetic poles in such a way that during folding of the two plates 21 and 22, stripe-like pole faces of opposite polarity are facing each other. In order to open the folded and magnetically adhering clip, the two plates 21 and 22 are provided with different dimensions. The rear plate is about 2 mm wider than the front plate 22, and the front plate 22 is about 2 mm longer than the rear plate 21. Thereby, the two plates may be opened manually against the adhering force of the magnets. Through the longitudinal eyelet-like opening 26, a pin 27 extends which is mounted at its ends in two bearings 28 and 29 on rear plate 21.

Thereby, the front part 22 may be spaced from the rear part 21 in accordance with the width of the eyelet 26 which corresponds to the thickness of the bank notes which have to be bundled. As a result, both plates 21 and 22 and, in turn, magnetic foils 24 and 25, remain parallel with respect to each other.

The two plates may also be provided with a small rim or edge 30, which corresponds to the thickness of both foils 24 and 25, so that a further stiffening of plates 21 and 22 is achieved. The surfaces of plates 21 and 22 may be plated with a suitable precious metal, so as to provide a more appealing look to the clip. Furthermore, the surface may also be roughened or carved. Finally, an embossed part 31 may be provided, which may exhibit the imitation of a bank note.

Thus, while only several embodiments of the present invention have been shown and described, it will be obvious that many modifications and changes may be made therein, without departing from the spirit and scope of the invention.

What is claimed is:

1. In a magnetic clipping device for magnetically retaining sheet-like articles of the type including two permanent magnet face-like elements which are coupled directly together by a hinge and between which a sheet-like article is retained, the improvement comprising:

said permanent magnet elements each comprising a relatively thin permanent magnetic foil having a thickness up to about 1 mm in which is embedded an anisotropic powder-like magnet material, each of said foils being magnetized in a direction perpendicular to the faces thereof and in a manner so as to define relatively wide, stripe-like magnetic pole zones for generating magnetic adhering faces, said permanent magnet foils and said zones thereof being so dimensioned and disposed that zones of opposite polarity are disposed opposite one another, and wherein said permanent magnetic foils comprise a front foil constructed in a sandwich style layer consisting of a permanent magnetic foil, a further magnetic foil, and a ferromagnetic ground terminal foil mounted therebetween, and a rear permanent magnetic foil constructed in a sandwich style layer consisting of a permanent magnet foil, and a further magnet foil, and a ferromagnetic ground terminal foil mounted therebetween; and said hinge being expansible to permit said foils to be maintained in a spaced parallel relationship to one another at a distance corresponding to the thickness of the article to be retained thereby.

2. The device according to claim 1, wherein said permanent magnet foils are made from a base material selected from the group consisting of rubber and plastic resin.

3. The device in accordance with claim 1, wherein a ferromagnetic foil which serves as a magnetic ground terminal is mounted on the outer surface of one of said permanent magnet foils.

4. The device in accordance with claim 1, wherein said permanent magnet foils are shaped as elongated rectangular plates, and wherein said foils comprise a wider rear foil for adhering to a ferromagnetic face, and a front foil to which is secured a ferromagnetic foil which serves as a ground terminal and which overhangs a lower free edge of said front foil.

5. The device in accordance with claim 1, wherein said foils are shaped as card-index cards for clipping therebetween an index card.

6. The device in accordance with claim 5, wherein a small window is disposed on the outer side of both of said permanent magnetic foils into which information corresponding to the card-index card may be inserted.

7. The device in accordance with claim 5, wherein a small frame is disposed on the outer side of both of said permanent magnetic foils upon which information corresponding to the card-index card may be written.

8. The device in accordance with claim 1, wherein said permanent magnet foils are shaped as electronic data processing card retainers for clamping the cards and are adherable to ferromagnetic faces.

9. The device in accordance with claim 1, wherein at least one of said foils is provided with a zone for print advertisements.

10. The device in accordance with claim 1, wherein said permanent magnet foils are shaped as file markers.

11. The device in accordance with claim 1, wherein said permanent magnetic foils are shaped as retaining means for clear plastic pouches or bags, and said foils include a rear foil which is coupled with an edge of the clear plastic pouch, and a front foil which presses a second edge of the pouch against the first one, thereby closing the pouch.

12. The device in accordance with claim 1, wherein said hinge for coupling two permanent magnetic foils is made of a flexible material selected from the group consisting of a plastic resin, silicon rubber and adhesive means.

13. The device according to claim 12, wherein said hinge is provided with a material reduction in the center thereof.

14. The device in accordance with claim 1, wherein said permanent magnetic foils include a front foil having an outer surface which is provided with a writable and erasable surface for entering and removing indicia and markings.

15. In a magnetic clipping device for magnetically retaining sheet-like articles of the type including two permanent magnet face-like elements which are coupled directly together by a hinge and between which a sheet-like article is retained, the improvement comprising:

said permanent magnet elements each being shaped as bank note clips for retaining bank notes therebetween and each comprising a relatively thin permanent magnetic foil having a thickness up to about 1 mm in which is embedded an anisotropic powder-like magnet material, each of said foils being magnetized in a direction perpendicular to the faces thereof and in a manner so as to define relatively wide, stripe-like magnetic pole zones for generating magnetic adhering faces, said permanent magnet foils and said zones thereof being so dimensioned and disposed that zones of opposite polarity are disposed opposite one another, said permanent magnetic foils being each mounted onto a solid plate and wherein said solid plates are coupled with each other along one edge by an expansible plate hinge comprising a longitudinally-extending eyelet mounted on one of said plates through which a pin extends, which pin is rigidly coupled with the other of said plates, said hinge being expansible in such a manner that said plates are spaced in a parallel relationship with respect to each other at a distance corresponding to the thickness of the article to be retained therein.

16. In a magnetic clipping device for magnetically retaining sheet-like articles of the type including two permanent magnet face-like elements which are coupled directly together by a hinge and between which a sheet-like article is retained, the improvement comprising:

said permanent magnet elements each being shaped as bank note clips for retaining bank notes therebetween and each comprising a relatively thin permanent magnetic foil having a thickness up to about 1 mm in which is embedded an anisotropic powder-like magnet material, each of said foils being magnetized in a direction perpendicular to the faces thereof in a manner so as to define relatively wide, stripe-like magnetic pole zones for generating magnetic adhering faces, said permanent magnet foils and said zones thereof being so dimensioned and disposed that zones of opposite polarity are disposed opposite one another, said permanent magnetic foils being each mounted onto a precious-metal plated solid plate and wherein said plates are coupled with each other along one edge by a plate hinge, said hinge comprising a longitudinally-extending eyelet mounted on one of said plates through which a pin extends which is rigidly coupled with the other of said plates in such a manner that said plates are spaced in a parallel relationship with respect to each other at a distance corresponding to the thickness of the article to be retained therebetween.

17. The device in accordance with claim 15 or 16, wherein said solid plates comprise a first plate and a second plate and said first plate is about 2 mm wider than said second plate, and said second plate is about b 2 mm longer than said first plate, and that both of said plates have a circumferential edge which corresponds to about the thickness of said permanent magnetic foils.

18. The device in accordance with claim 15 or 16, wherein an embossed like imitation of a bank note is provided on a surface of one of said plates.

* * * * *